US006919693B2

(12) United States Patent
Fushimi

(10) Patent No.: US 6,919,693 B2
(45) Date of Patent: Jul. 19, 2005

(54) HIGH-VOLTAGE TRANSFORMER AND DISCHARGE LAMP DRIVING APPARATUS

(75) Inventor: Tadayuki Fushimi, Tokyo (JP)

(73) Assignees: Sumida Technologies Inc., Tokyo (JP); Sumida Corporation, Tokyo (JP)

( * ) Notice: Subject to any disclaimer, the term of this patent is extended or adjusted under 35 U.S.C. 154(b) by 0 days.

(21) Appl. No.: 10/670,198

(22) Filed: Sep. 26, 2003

(65) Prior Publication Data

US 2004/0212319 A1 Oct. 28, 2004

(30) Foreign Application Priority Data

Apr. 25, 2003 (JP) ..... 2003-122486

(51) Int. Cl.[7] ..... H05B 37/02
(52) U.S. Cl. ..... 315/219; 315/276
(58) Field of Search ..... 315/276, 209 R, 315/219, 224–226, 291, 360, DIG. 5, DIG. 7; 323/355; 336/222, 225

(56) References Cited

U.S. PATENT DOCUMENTS 3,967,159 A * 6/1976 Dendy et al. ..... 315/247
4,187,450 A * 2/1980 Chen ..... 315/278
5,192,897 A * 3/1993 Vossough et al. ..... 315/308
5,729,095 A * 3/1998 Shimokawa et al. ..... 315/176
6,316,883 B1 * 11/2001 Cho et al. ..... 315/247
6,628,093 B2 * 9/2003 Stevens ..... 315/291
6,747,421 B2 * 6/2004 Kohn ..... 315/291
2004/0113569 A1 * 6/2004 Henry ..... 315/307

FOREIGN PATENT DOCUMENTS

JP 2002-353044 12/2002

* cited by examiner

*Primary Examiner*—Thuy V. Tran
(74) *Attorney, Agent, or Firm*—Snider & Associates; Ronald R. Snider

(57) ABSTRACT

A high-voltage transformer for lighting a plurality of discharge lamps has a primary coil for inputting an AC voltage and a secondary coil for outputting a predetermined AC voltage higher than the AC voltage inputted. The primary coil has a starter primary winding for initially lighting the discharge lamps, and a normal lighting primary winding for normally lighting the discharge lamps.

10 Claims, 10 Drawing Sheets

TRANSFORMER WIRING DIAGRAM

DISCHARGE LAMP DRIVING CIRCUIT

EMBODIMENT

TRANSFORMER WIRING DIAGRAM

DISCHARGE LAMP DRIVING CIRCUIT

WIRING DIAGRAM

EMBODIMENT

DISCHARGE LAMP DRIVING CIRCUIT

DISCHARGE LAMP DRIVING CIRCUIT

EMBODIMENT

TRANSFORMER WIRING DIAGRAM

DISCHARGE LAMP DRIVING CIRCUIT

HIGH-VOLTAGE TRANSFORMER AND DISCHARGE LAMP DRIVING APPARATUS

RELATED APPLICATIONS

This application claims the priority of Japanese Patent Application No. 2003-122486 filed on Apr. 25, 2003, which is incorporated herein by reference.

BACKGROUND OF THE INVENTION

1. Field of the Invention

The present invention relates to a high-voltage transformer and a discharge lamp driving apparatus which are used, for example, in a lighting circuit of a discharge lamp for backlight in a liquid crystal display panel and, in particular, to a high-voltage transformer and a discharge lamp driving apparatus, used in a DC/AC inverter circuit, for simultaneously lighting a plurality of discharge lamps.

2. Description of the Prior Art

It has conventionally been known to discharge/light a plurality of cold cathode fluorescent lamps (hereinafter referred to as CCFLs) simultaneously as backlight for various liquid crystal display panels used in notebook PCs, for example. Using a plurality of CCFLs as such can respond to demands for higher luminance and uniform illumination in liquid crystal display panels.

Known as a typical circuit for lighting this kind of CCFL is an inverter circuit which converts a DC voltage of about 12 V into a high-frequency voltage of about 2,000 V or higher at 60 kHz by using a high-voltage transformer, so as to start discharging. After the discharging is started, the inverter circuit regulates the high-frequency voltage so as to lower it to a voltage of about 800 V which is required for keeping the discharge of CCFL.

As high-voltage transformers (inverter transformers) used in such an inverter circuit, those with a small size have been in use in view of the demand for making liquid crystal display panels thinner. Since the high-voltage transformers are necessary by the number of CCFLs in a single liquid crystal display, there is an urgent need for establishing a technique for further saving their space and manufacturing cost. Known as an example responding to such a need is the discharge lamp driving circuit shown in FIG. 12.

This discharge lamp driving circuit is configured such that a DC input voltage is fed to the primary side of a high-voltage transformer 610 by way of a known Royer oscillation circuit 600, so as to generate a high voltage of about 2,000 V or higher on the secondary side of the high-voltage transformer 610 at the time when discharge lamps start lighting, whereas the high voltage on the secondary side is applied to cold cathode fluorescent lamps CCFL1, CCFL2 by way of ballast capacitors Cb1, Cb2, respectively. Connecting the ballast capacitors Cb1, Cb2 to the CCFL1, CCFL2, respectively, in series can eliminate fluctuations in the starter voltage of each lamp, whereby a plurality of CCFLs can be lit by a single transformer while suppressing fluctuations in the discharging operation of each CCFL.

However, a voltage of (1,600 to 2,000 V between both ends of a CCFL) 2 to 2.5 times that at the time of normal lighting (800 V between both ends) is necessary at the time when the CCFL starts lighting, and a voltage of about 400 V or higher is divisionally applied between both ends of a ballast capacitor Cb connected thereto, whereby a high voltage of at least about 2,000 V is continuously outputted from the secondary side of the transformer when the CCFL starts lighting and keeps normally lighting.

Continuously outputting such a high voltage lowers the reliability of the transformer, thus making it difficult to secure safety against the isolation voltage between turns of the secondary coil in the transformer and the like.

The secondary voltage may be varied between when the CCFL starts lighting and lights normally, so that the voltage is lowered at the time of normal lighting. However, the high-voltage transformer 610 has no function to regulate its voltage. Though the circuit part for driving the high-voltage transformer 610 has a PWM control function in general, this is usually a voltage control function for keeping the lamp lighting at the time of normal lighting, whereby it is essentially difficult to switch a starter voltage of about 2,000 V or higher to a normal lighting voltage of about 800 V.

Therefore, when employing a technique for switching the secondary voltage between the initial lighting time and the normal lighting time, a configuration basically different from conventional ones is required to be developed.

SUMMARY OF THE INVENTION

It is an object of the present invention to provide a high-voltage transformer with switchable secondary voltages and a discharge lamp driving apparatus, which can stably keep a plurality of discharge lamps lighting with a single transformer, improve the reliability of the transformer, and secure safety against the isolation voltage between turns of the secondary coil of the transformer and the like.

For achieving such an object, the present invention provides a high-voltage transformer for lighting a plurality of discharge lamps, the high-voltage transformer comprising a primary coil for inputting an AC voltage and a secondary coil for outputting a predetermined AC voltage higher than the AC voltage inputted, wherein the primary coil comprises a starter primary winding for initially lighting the discharge lamps, and a normal lighting primary winding for normally lighting the discharge lamps.

The starter primary winding may be comprised by a part of the normal lighting primary winding by providing a tap in the normal lighting primary winding, or provided independently from the normal lighting primary winding so as to have a diameter smaller than that of the normal lighting primary winding.

Preferably, the starter primary winding has a smaller number of turns than that of the normal lighting primary winding.

The high-voltage transformer may be an inverter transformer.

The discharge lamp may be a cold cathode fluorescent lamp.

The present invention provides a discharge lamp driving apparatus comprising the high-voltage transformer of the present invention, the apparatus further comprising:

first switching means for controlling an energizing state of the starter primary winding; and second switching means for controlling an energizing state of the normal lighting primary winding.

Preferably, a switching frequency for driving the first switching means and a switching frequency for driving the second switching means are switchable therebetween.

Preferably, the first and/or second switching means is a full-bridge circuit.

Preferably, the first and second switching means are partly used in common.

Preferably, the first switching means energizes the starter primary winding for a predetermined time, and then the second switching means energizes the normal lighting primary winding.

DESCRIPTION OF THE PREFERRED EMBODIMENTS

In the following, the high-voltage transformer in accordance with an embodiment of the present invention will be explained in detail with reference to the accompanying drawings.

Figure 1:
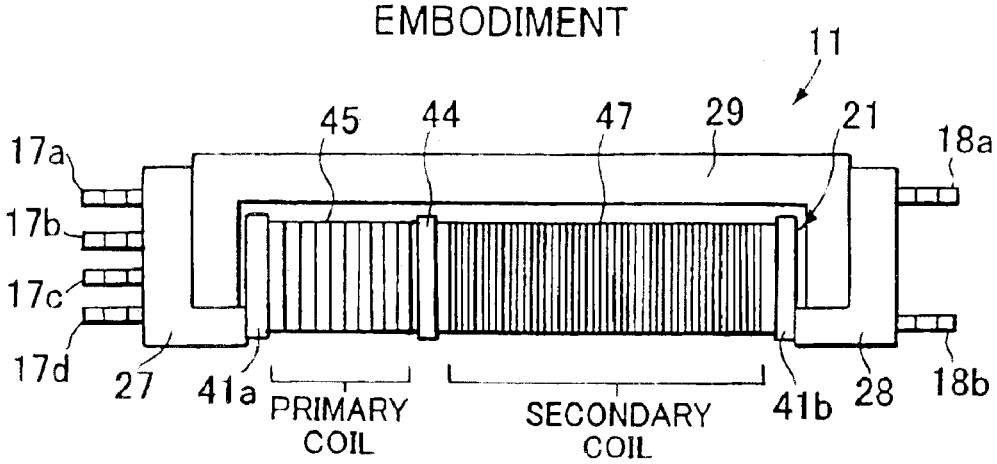
FIG. 1 is an overall plan view of the high-voltage transformer in accordance with an embodiment of the present invention.
Figure 2:
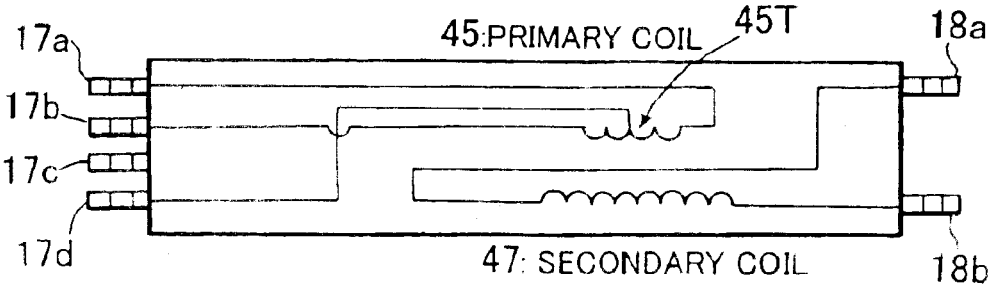
FIG. 2 is a wiring diagram of the high-voltage transformer in accordance with the above-mentioned embodiment.

FIG. 1 is a plan view showing the exterior of the high-voltage transformer in accordance with an embodiment of the present invention, whereas FIG. 2 is a wiring diagram showing a characteristic concept of the high-voltage transformer.

The high-voltage transformer 11 in accordance with this embodiment shown in FIG. 1 is an inverter transformer used in a DC/AC inverter circuit for simultaneously discharging/lighting two CCFLs (cold cathode fluorescent lamps). Its primary coil 45 and secondary coil 47 are wound about a common rod-shaped magnetic core (hidden in FIG. 1) made of ferrite or the like which is a soft magnetic material, and are electromagnetically connected to each other by the common rod-shaped magnetic core.

An insulating partition 44 is disposed between the primary coil 45 and the secondary coil 47.

In practice, the primary coil 45 and secondary coil 47 are wound about the outer periphery of a tubular bobbin 21 having a rectangular cross section, whereas the rod-shaped magnetic core is inserted in the bobbin 21. Both end faces of the bobbin 21 are provided with brims 41*a*, 41*b*.

The rod-shaped magnetic core is electromagnetically connected to a frame-shaped magnetic core 29 formed from the same material as the rod-shaped magnetic core, whereby a magnetic path is formed.

Here, the amount of gap between the rod-shaped magnetic core and the frame-shaped magnetic core 29 is determined by how much leakage magnetic flux is to be generated, and can be made substantially zero. Also, without providing the frame-shaped magnetic core 29, the magnetic core may be constructed by using the rod-shaped magnetic core alone, so as to form an open magnetic path structure.

The leading end, intermediate terminal 45T, and terminating end of the primary coil 45 are respectively connected to terminal pins 17*a*, 17*b*, 17*d* secured to a coil terminal support 27. The leading and terminating ends of the secondary coil 47 are respectively connected to terminal pins 18*a*, 18*b* secured to a coil terminal support 28. The terminal supports 27, 28 are formed from an insulating material.

As shown in FIG. 2, the high-voltage transformer 11 is wired such that both ends of the primary coil 45 are connected to the terminal pins 17*a*, 17*b*, whereas the intermediate terminal 45T is connected to the terminal pin 17*d*. On the other hand, the secondary coil 47 is connected to the terminal pins 18*a*, 18*b*. A starter primary winding is formed by the winding between one of the ends of the primary coil 45 and the intermediate terminal 45T, whereas a normal lighting primary winding is formed by the winding between the ends of the primary coil 45. This forms two kinds of primary winding having respective numbers of turns different from each other with a common part.

Figure 11:
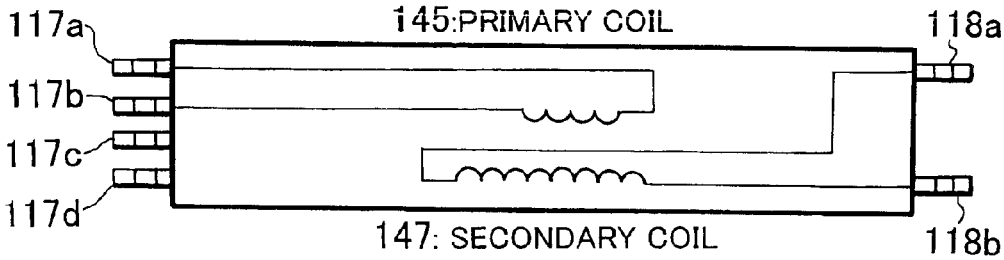
FIG. 11 PRIOR ART
FIG. 11 is a transformer wiring diagram showing a high-voltage transformer in accordance with the prior art.
Figure 12:
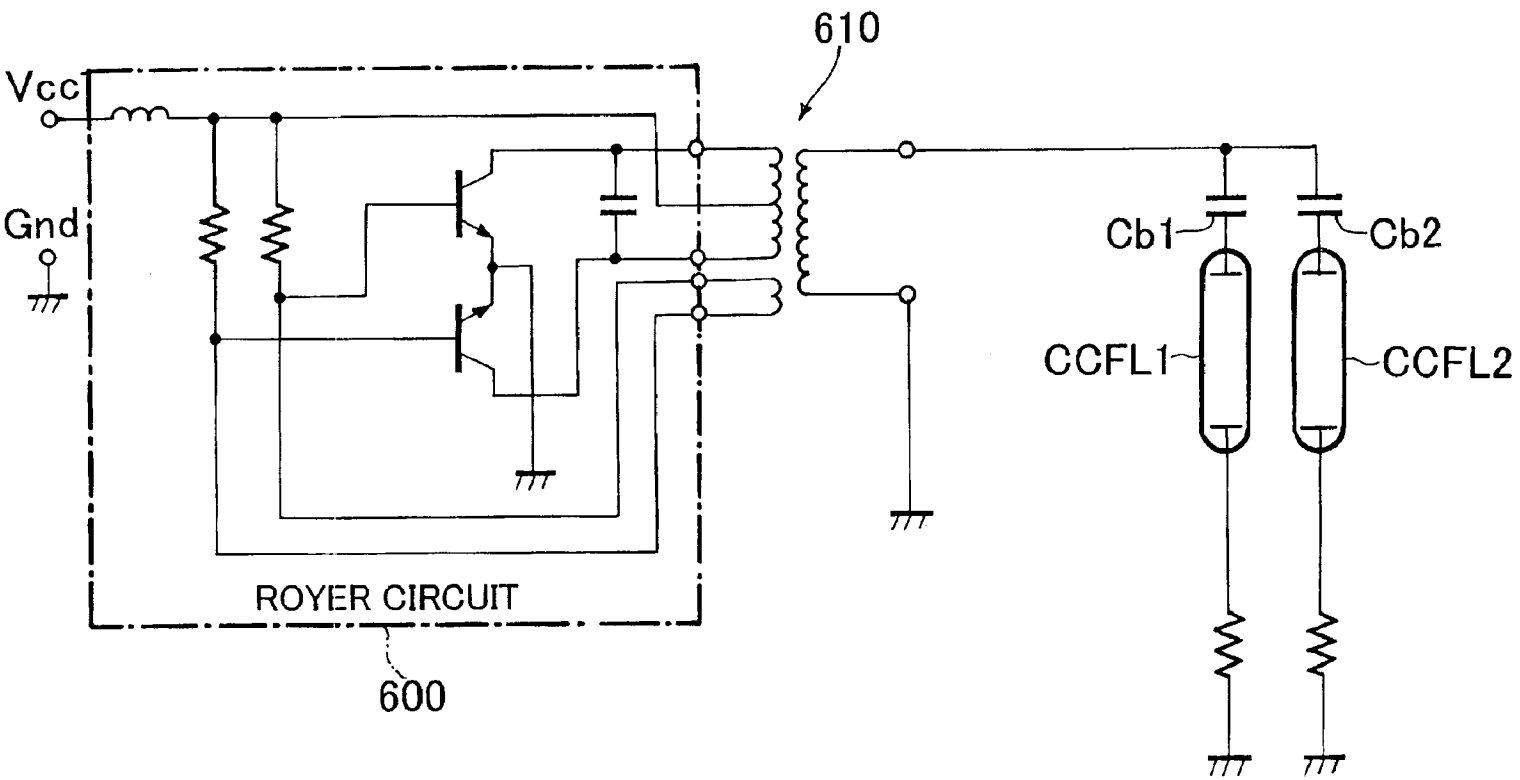
FIG. 12 PRIOR ART
FIG. 12 is a circuit diagram showing a discharge lamp driving circuit in accordance with the prior art.

As mentioned above, FIG. 2 shows a characteristic feature of the high-voltage transformer 11 in accordance with this embodiment, which is more clearly seen when compared with FIG. 11 showing the state of wiring of a conventional high-voltage transformer in which both ends of a primary coil 145 are respectively connected to terminal pins 117*a*, 117*b* whereas both ends of a secondary coil 147 are respectively connected to terminal pins 118*a*, 118*b*.

Figure 3:
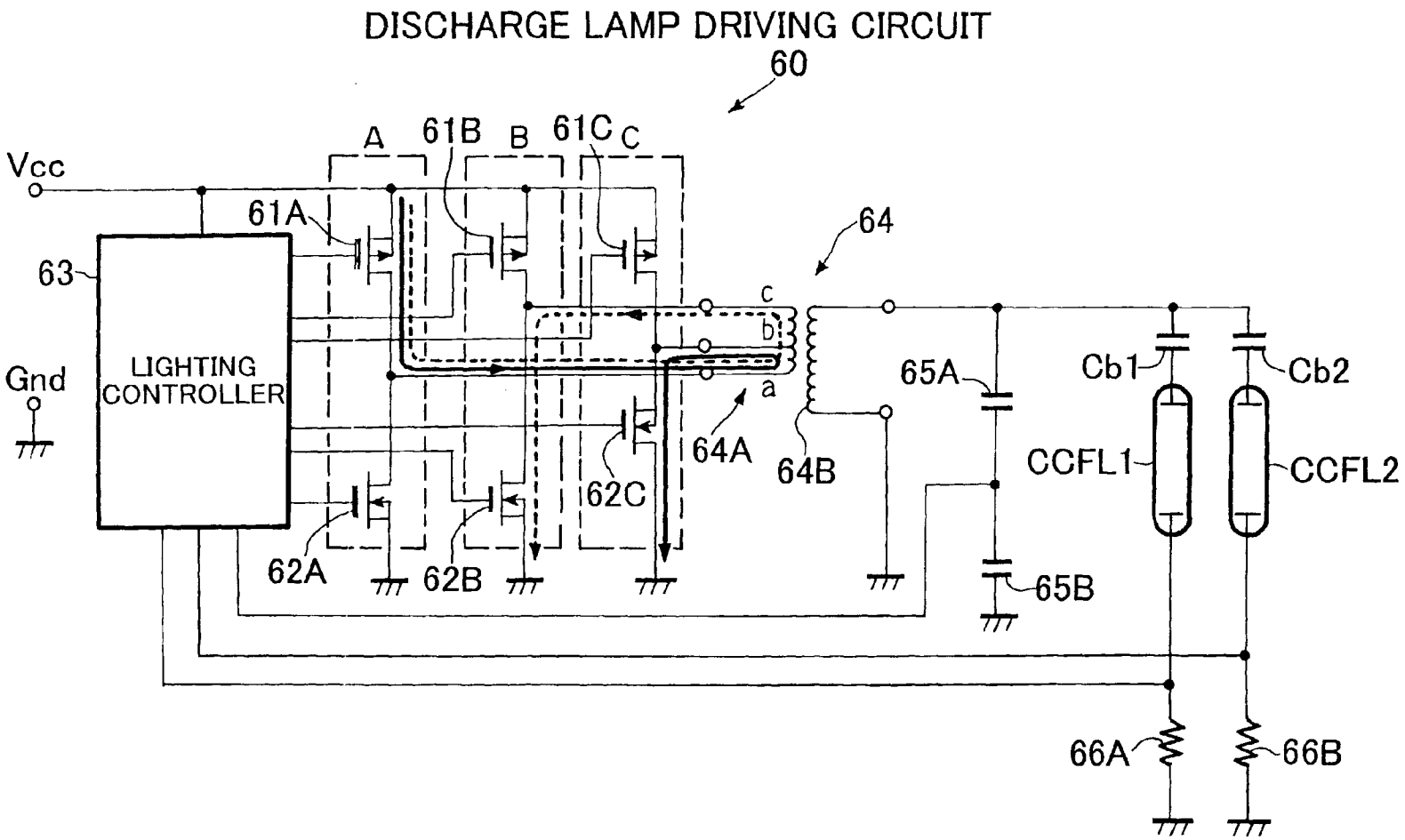
FIG. 3 is a circuit diagram showing the discharge lamp (apparatus) in accordance with an embodiment of the present invention.

FIG. 3 shows a discharge lamp driving circuit equipped with a high-voltage transformer 64 in accordance with this embodiment.

In this discharge lamp driving circuit, two CCFLs (CCFL1, CCFL2) connected to the secondary side of the high-voltage transformer 64 are driven to light, whereas a full-bridge circuit 60 and a lighting controller 63 which are connected to the primary side of the high-voltage transformer 64 construct an inverter circuit.

As shown in FIG. 3, the full-bridge circuit 60 having a voltage supplied from a DC power line ($V_{cc}$) generates an AC voltage. The high-voltage transformer 64 raises the AC voltage fed to the primary coil 64A, thereby causing the secondary coil 64B to generate a high AC voltage. Thus generated high AC voltage is applied to the two CCFLs (CCFL1, CCFL2) connected to the secondary coil 64B. In order for the two CCFLs having a high AC voltage applied thereto as such to stably light at the same time, ballast capacitors (Cb1, Cb2) are connected between the secondary coil 64B of the high-voltage transformer 64 and the respective CCFLs (CCFL1, CCFL2).

In this embodiment, as explained in connection with FIG. 2, a starter primary winding (with a smaller number of turns) is formed by the winding between one of the ends (a or c) of the primary coil 64A and the intermediate terminal (b), whereas a normal lighting primary winding (with a greater number of turns) is formed by the winding between the ends (a and c) of the primary coil 64A.

In this embodiment, two primary windings are provided because of the following reason:

At the time when a CCFL starts lighting, a voltage which is 2 to 2.5 times that at the time of normal lighting is necessary, whereby a high voltage of about 1,600 to 2,000 V is applied between both ends of the CCFL in general. Therefore, the isolation break down voltage between turns on the secondary coil or the like approaches its limit when in use.

In order for the single high-voltage transformer 64 to light a plurality of CCFLs stably at the same time, a ballast capacitor Cb is connected to its corresponding CCFL, whereby a voltage of 400 V, for example, is divisionally applied between both ends of the ballast capacitor Cb. Therefore, the CCFLs cannot start lighting unless a voltage obtained by adding, for example, 400 V to the above-mentioned voltage of about 1,600 to 2,000 V is generated on the secondary side 64B.

When such a high voltage is continuously generated, it is hard to secure safety against the isolation voltage between turns of the secondary coil in the transformer. Also, it lowers the reliability of the transformer.

Therefore, when discharge lamps start lighting, the starter primary winding (a–b) having a smaller number of turns (e.g., 10 turns) is used as shown in FIGS. 2 and 3, so as to yield a higher step-up ratio, thereby causing the secondary coil 64B to generate a high voltage (e.g., 2,000 V) required for the discharge lamps to start lighting. After the CCFLs start lighting, on the other hand, the normal lighting primary winding (a–c) having a greater number of turns (e.g., 18 turns) is used, so as to yield a lower step-up ratio, thereby causing the secondary coil 64B to generate a low voltage (e.g., 1,200 V) required for the discharge lamps to keep lighting.

The full-bridge circuit 60 comprises a first-stage switching section A, a second-stage switching section B, and a third-stage switching section C, each including two FETs. The starter primary winding (a–b) is energized when the first switching section A and third switching section C are switched therebetween, whereas the normal lighting primary winding (a–c) is energized when the first switching section A and second switching section B are switched therebetween.

Namely, the starter primary winding (a–b) is energized when a first state where FETs 61A and 62C are turned ON and a second state where FETs 62A and 61C are turned ON are alternately repeated. In FIG. 3, the solid line shows the current passage in the first state.

On the other hand, an AC voltage is applied to the normal lighting primary winding (a–c) when a first state where FETs 61A and 62B are turned ON and a second state where FETs 62A and 61B are turned ON are alternately repeated. In FIG. 3, the dotted line shows the current passage in the first state.

Switching operations of the FETs 61A to 61C and 62A to 62C are controlled by a lighting controller 63. The configuration of the lighting controller 63 will be explained later.

Specific voltage values occurring in the secondary coil when predetermined voltages are applied to the starter primary winding (a–b) and normal lighting primary winding (a–c) will now be calculated.

In this embodiment, as mentioned above, the number of turns of the starter primary winding (a–b) is made smaller than that of the normal lighting primary winding (a–c). In the example mentioned above, the number of turns $N_P$ is 10 in the starter primary winding (a–b), and 18 in the normal lighting primary winding (a–c), which will be used in the following calculations.

Let the number of turns $N_S$ of the secondary coil 64B be 1,800, and the input voltage $V_{in}$ on the primary side be 12 V.

(1) The output voltage $V_{out}$ of the secondary coil in the case where the starter primary winding (a–b) is energized:

$$V_{out}=V_{in}\times 1.1\times N_S/N_P=12\ V\times 1.1\times 1{,}800/10=2{,}376\ V$$

(2) The output voltage $V_{out}$ of the secondary coil in the case where the normal lighting primary winding (a–c) is energized:

$$V_{out}=V_{in}\times 1.1\times N_S/N_P=12\ V\times 1.1\times 1{,}800/18=1{,}320\ V$$

In this case, assuming each ballast capacitor Cb to have a capacitance of 66 pF, the voltage $V_{Cb}$ between both ends of the capacitor is 792 V when the discharge lamps start lighting, and 440 V when the discharge lamps normally light. Therefore, the voltage $V_L$ between both electrodes of CCFL is 1,584 V when the discharge lamps start lighting, and 880 V when the discharge lamps normally light.

Thus, in the specific example mentioned above, a high voltage of 2,376 V is generated from the secondary coil 64B when the discharge lamps start lighting, whereas the voltage generated from the secondary coil 64B is lowered to 1,320 V at the time of normal lighting after the discharge lamps start lighting. This can prevent the secondary coil 64B of the high-voltage transformer 64 from continuously outputting a high voltage of about 2,000 V or more, and thus can improve the reliability of the transformer and the safety against the isolation voltage between turns of the secondary coil in the transformer and the like.

Though a voltage is divisionally applied between both ends of each ballast capacitor Cb by a predetermined ratio, the above-mentioned specific example can secure 1,584 V as the voltage $V_L$ between both electrodes of the CCFL at the time when the discharge lamps start lighting, and 880 V as the voltage $V_L$ between both electrodes of the CCFL at the time when the discharge lamps normally light, whereby operations for initially lighting the discharge lamps and normally lighting the discharge lamps can be carried out favorably.

Figure 4:
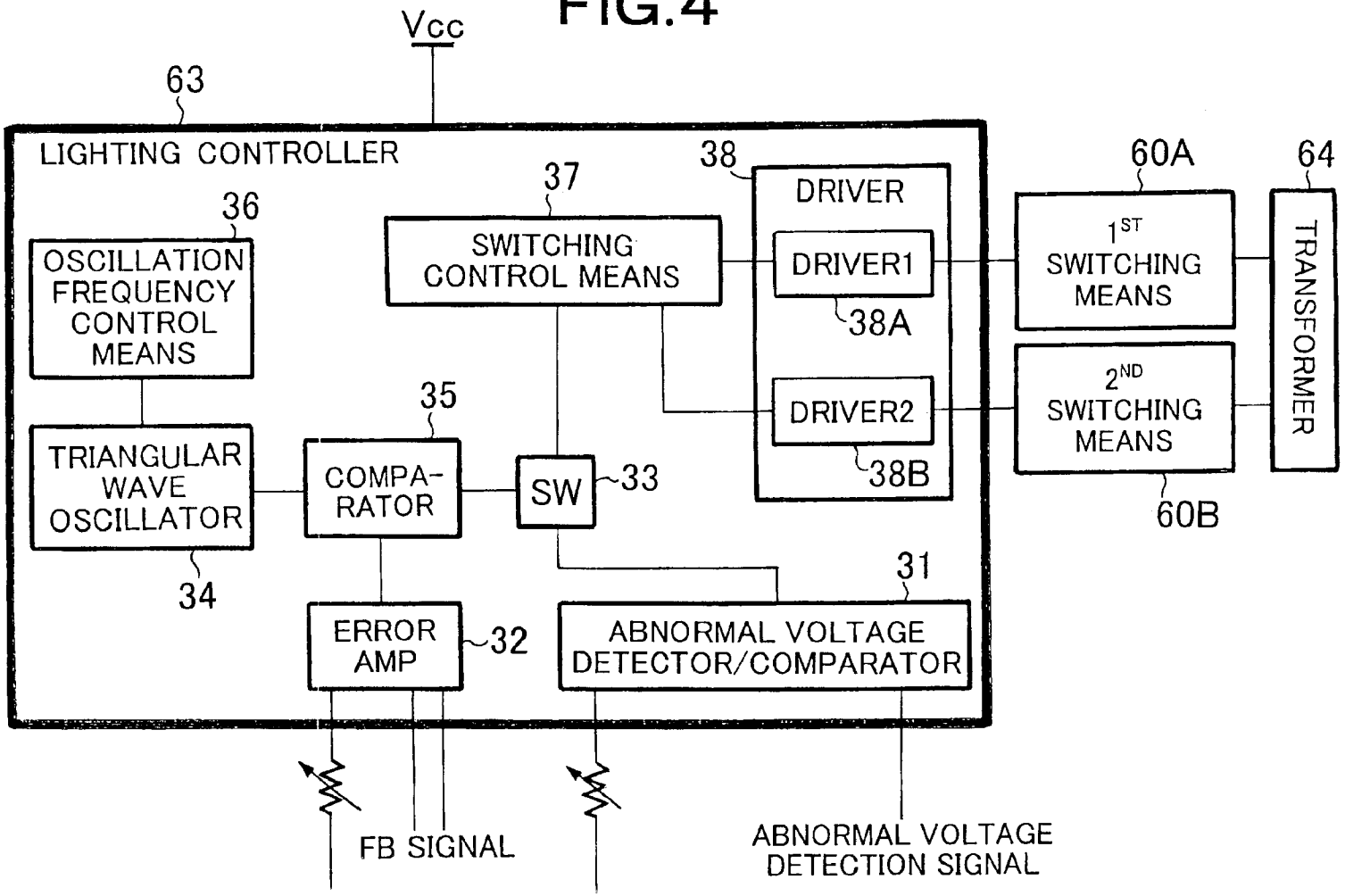
FIG. 4 is a block diagram showing the lighting controller shown in FIG. 3.

FIG. 4 is a block diagram showing the configuration of the above-mentioned lighting controller 63. The lighting controller 63 regulates the switching of the full-bridge circuit 60 by PWM control. In the full-bridge circuit 60 in FIG. 4, for the sake of convenience, the part relating to the switching for initially lighting the discharge lamps is referred to as first switching means 60A, whereas the part relating to the switching for normally lighting the discharging lamps is referred to as second switching means 60B.

The lighting controller 63 comprises an oscillation frequency control means 36 for outputting a square wave at a predetermined frequency; a triangular wave oscillator 34 for converting the square wave of the oscillation frequency control means 36 into a triangular wave; and a comparator 35 for comparing an error level signal from an error amplifier 32 and the triangular wave signal outputted from the triangular wave oscillator 34 and outputting a PWM control signal, which attains an H level during the period when the triangular wave signal is greater, to a switching control means 37 by way of a switch 33. During the H level period of the inputted PWM control signal, the switching control means 37 regulates two driver devices 38A, 38B within a driver section 38 so that one of them is selectively turned ON. When the first driver device 38A is turned ON, the first switching means 60A is driven, so as to carry out the switching operation for initially lighting the discharge lamps. When the second driver device 38B is turned ON, the second switching means 60B is driven, so as to carry out the switching operation for normally lighting the discharge lamps.

As shown in FIG. 3, respective voltages on the Gnd side of two CCFLs are fed into the error amplifier 32 as feedback signals (FB signals) together with a reference signal. Since resistors 66A, 66B are connected to the respective CCFLs on the Gnd side, the feedback signals correspond to the respective voltage values of the resistors 66A, 66B between both ends thereof.

When the value of current flowing through any of CCFLs is lowered, the feedback signals decrease, so that the level of an error level signal fed from the error amplifier 32 to the comparator 35 becomes lower, whereby the H level period of the PWM control signal fed into the switching control means 37 becomes longer. This elongates the driving period for each of the switching means 60A, 60B, whereby a higher current can be caused to flow through the CCFLs.

The lighting controller 63 further comprises an abnormal voltage detector/comparator 31. As shown in FIG. 3, the voltage value between two capacitors 65A, 65B connected to the secondary side of the high-voltage transformer 64 is fed into the abnormal voltage detector/comparator 31 together with a reference signal. When both of the CCFLs are damaged, an abnormally high voltage occurs on the secondary side of the high-voltage transformer 64 in general, thus yielding a fear of the high-voltage transformer 64 being broken. Therefore, if it is determined that an abnormally high voltage is detected by the abnormal voltage detector/comparator 31, a switch releasing signal is sent from the abnormal voltage detector/comparator 31, so as to turn OFF the switch 33 immediately, so that the switching control means 37 stop driving the switching means 60A, 60B, thereby blocking the voltage from being fed into the high-voltage transformer 64. This prevents the high-voltage transformer 64 from being damaged.

Figure 5A:
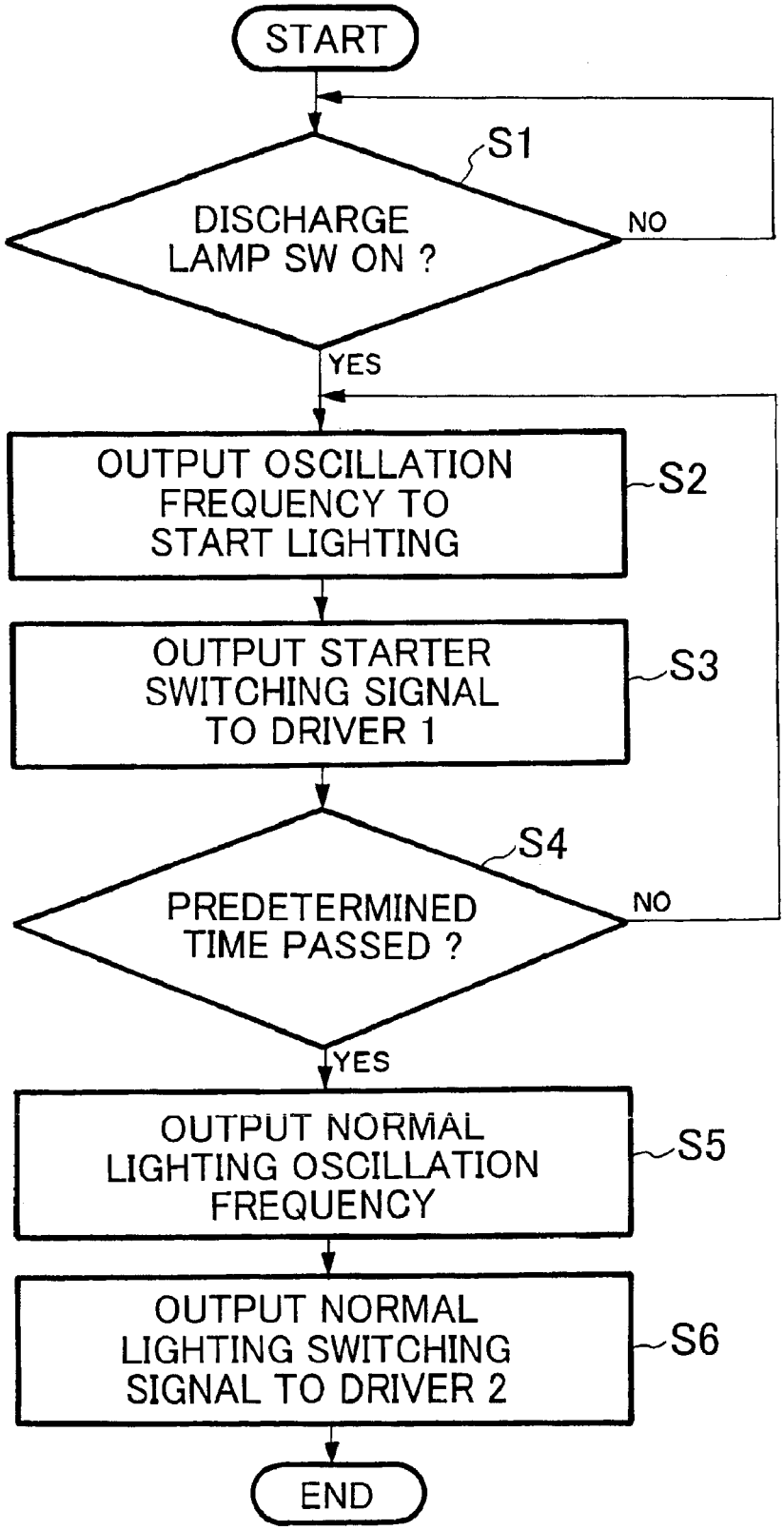
FIGS. 5A and 5B are flowcharts showing the processing procedure of a CPU controlling the oscillation frequency control means shown in FIG. 4.

FIG. 5A is a flowchart showing a processing procedure of a CPU (not depicted) for controlling the oscillation frequency control means 36, whereas its specific procedure is stored in a ROM attached to the CPU.

Referring to FIG. 5A, it is always determined whether a discharge lamp (CCFL) switch is turned ON or not (S1). If it is determined that an ON state is attained, the oscillation frequency control means 36 is caused to output an oscillation frequency signal at the oscillation frequency for initially lighting the discharge lamps (S2), and a starter switching signal is fed to the first driver device 38A (S3). Thereafter, it is determined whether a predetermined period of time (e.g., 2 to 3 seconds) has elapsed from when the discharge lamps started lighting (when the oscillation frequency signal was outputted) or not (S4). If it is determined that the predetermined period of time has passed, the oscillation frequency control means 36 is caused to output an oscillation frequency signal at the oscillation frequency for normally lighting the discharge lamps (S5), and a switching signal for normally lighting the discharge lamps is fed to the second driver device 38B (S6).

Thus, in this embodiment, the switching frequency is set high for a predetermined period from when the CCFLs start lighting (from when the oscillation frequency signal is outputted), so that the resonance with the ballast capacitors Cb is carried out favorably, whereby the lighting of CCFLs can be improved.

When the oscillation frequency is made higher, the switching frequency of the first switching means 60A rises, thereby increasing the core loss such as iron loss and eddy current in the core part of the high-voltage transformer 64, which may deteriorate the conversion efficiency of the transformer 64, or enhancing the switching loss caused by the first switching means 60A, which may increase the amount of heat generation. Since the period during which the frequency is made high is short as mentioned above, however, the above-mentioned core loss and switching loss are negligible.

Figure 5B:
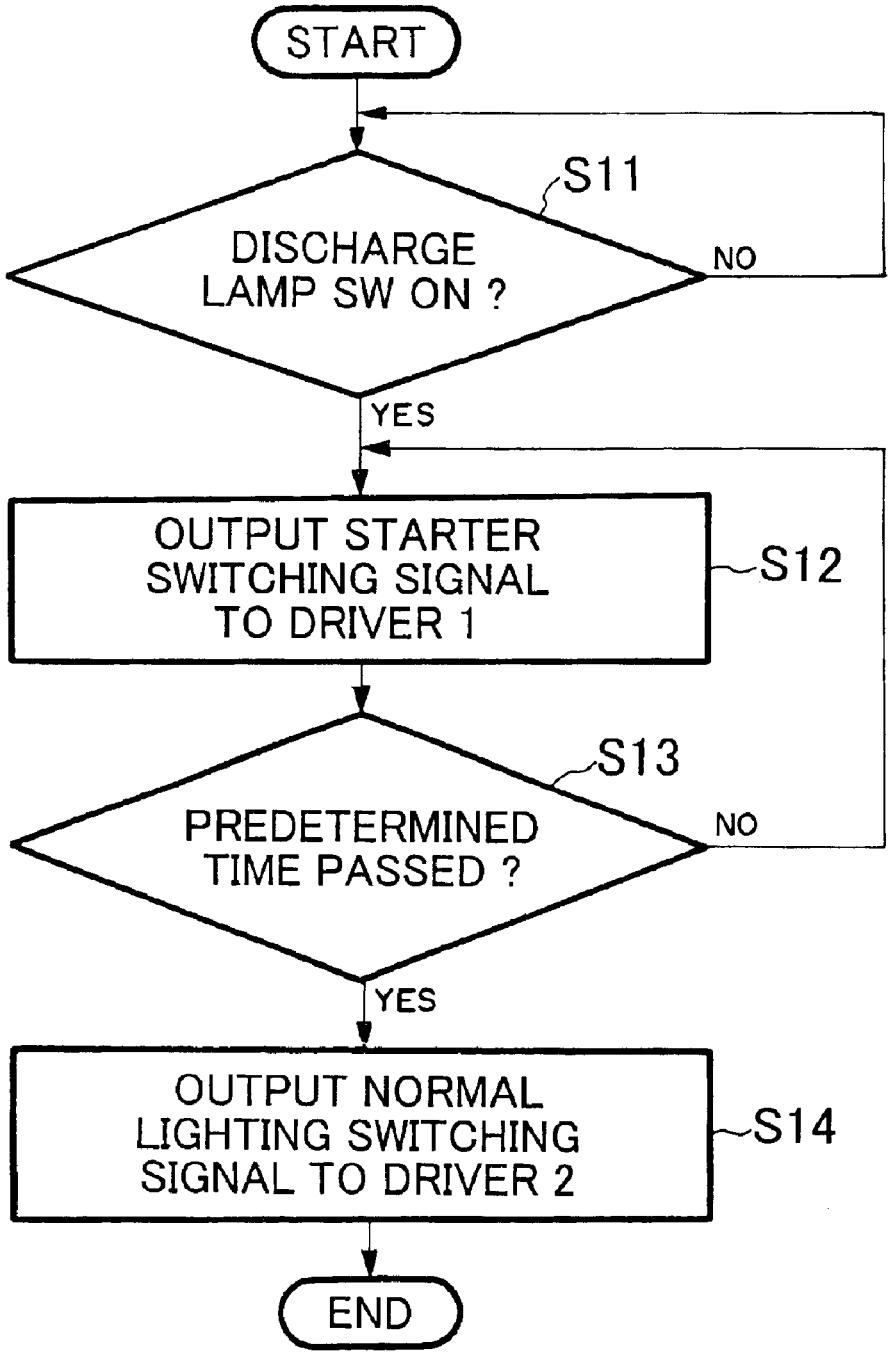

The frequency of the oscillation frequency signal from the oscillation frequency control means 36 may be made constant. FIG. 5B is a flowchart showing a processing procedure of the CPU (not depicted) controlling the oscillation frequency control means 36 in this case. In this procedure, it is always determined whether the discharge lamp (CCFL) switch is turned ON or not (S11). If it is determined that an ON state is attained, a starter switching signal is fed to the first driver device 38A (S12). Thereafter, it is determined whether a predetermined period of time has elapsed from when the discharge lamps started lighting (when the switching signal was outputted) or not (S13). If it is determined that the predetermined period of time has passed, a normal lighting switching signal is fed to the second driver device 38B (S14).

Without being restricted to the above-mentioned embodiments, the high-voltage transformer and discharge lamp driving apparatus of the present invention can be modified in various manners.

Figure 6:
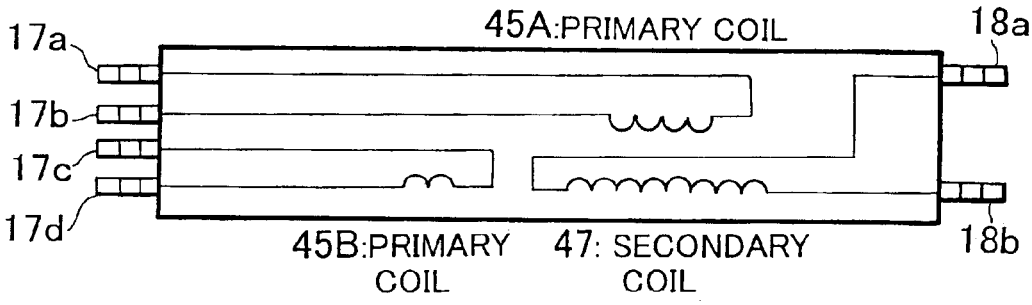
FIG. 6 is a view showing a modified mode of the transformer wiring diagram of FIG. 2.

FIG. 6 shows a modified mode of the transformer wiring diagram of FIG. 2. In this mode, a normal lighting primary coil 45A and a starter primary coil 45B are formed independently from each other. Both ends of the normal lighting primary coil 45A are connected to terminal pins 17*a*, 17*b*, respectively, whereas both ends of the starter primary coil 45B are connected to terminal pins 17*c*, 17*d*, respectively. In this case, for example, the number of turns is 10 in the starter primary coil 45B, and 18 in the normal lighting primary coil 45A.

Figure 7:
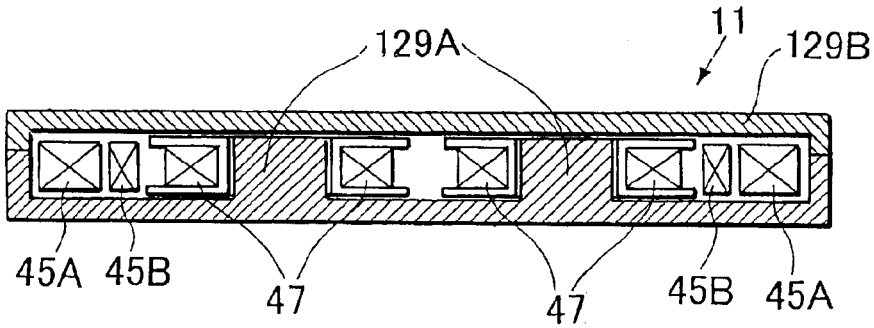
FIG. 7 is a sectional view showing an example in which the present invention is applied to a so-called double transformer type high-voltage transformer.

FIG. 7 is a sectional view showing an example in which the present invention is applied to a so-called double transformer type high-voltage transformer 11. It is clear that the starter primary coil 45B and the normal lighting primary coil 45A are formed independently from each other in this mode as well.

As shown in FIG. 7, the center magnetic core 129A is electromagnetically connected to the frame-shaped magnetic core 129B, whereby a magnetic path is formed.

Figure 8:
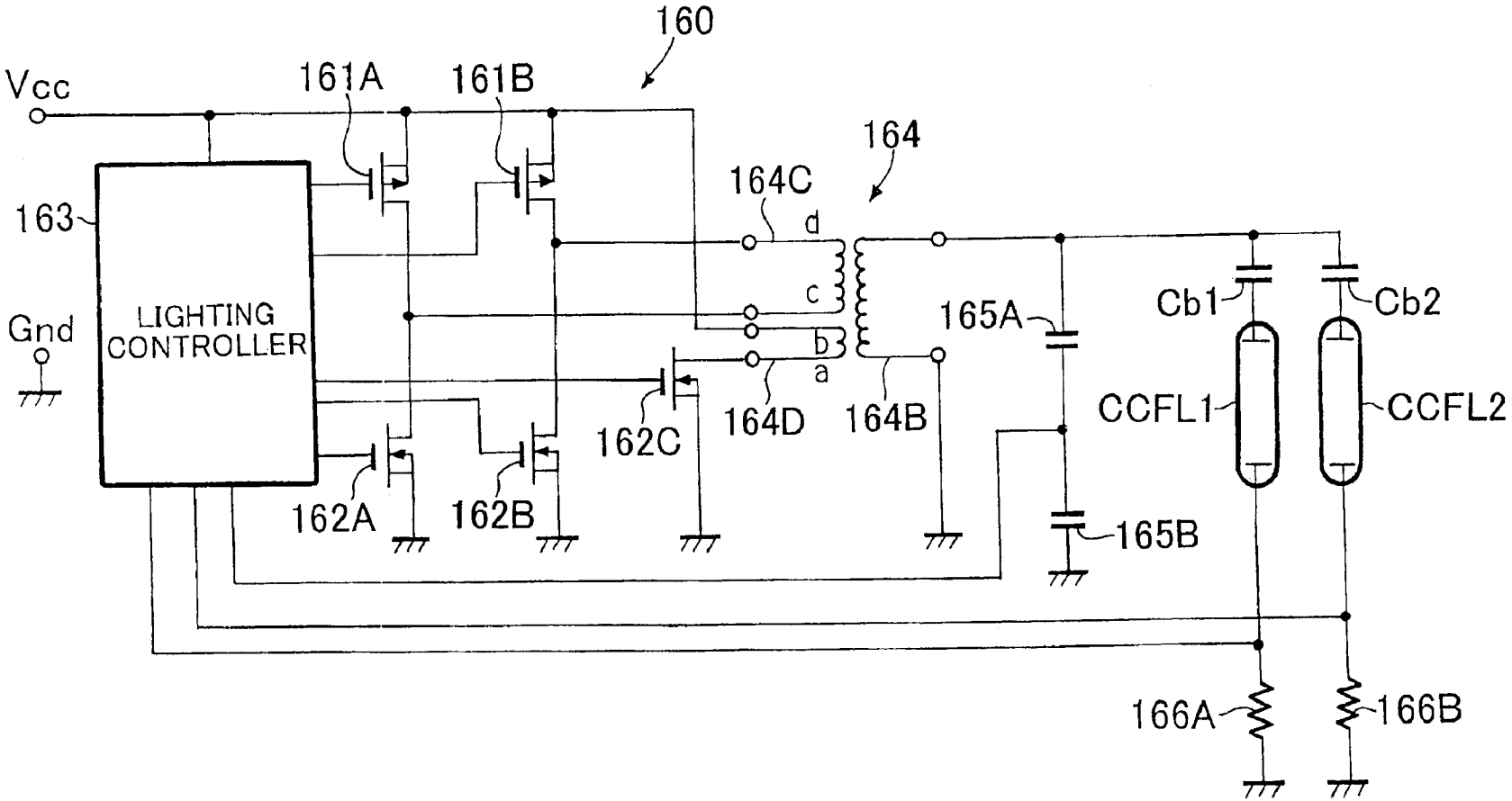
FIG. 8 is a circuit diagram showing a modified mode of the discharge lamp driving circuit of FIG. 3.
Figure 9:
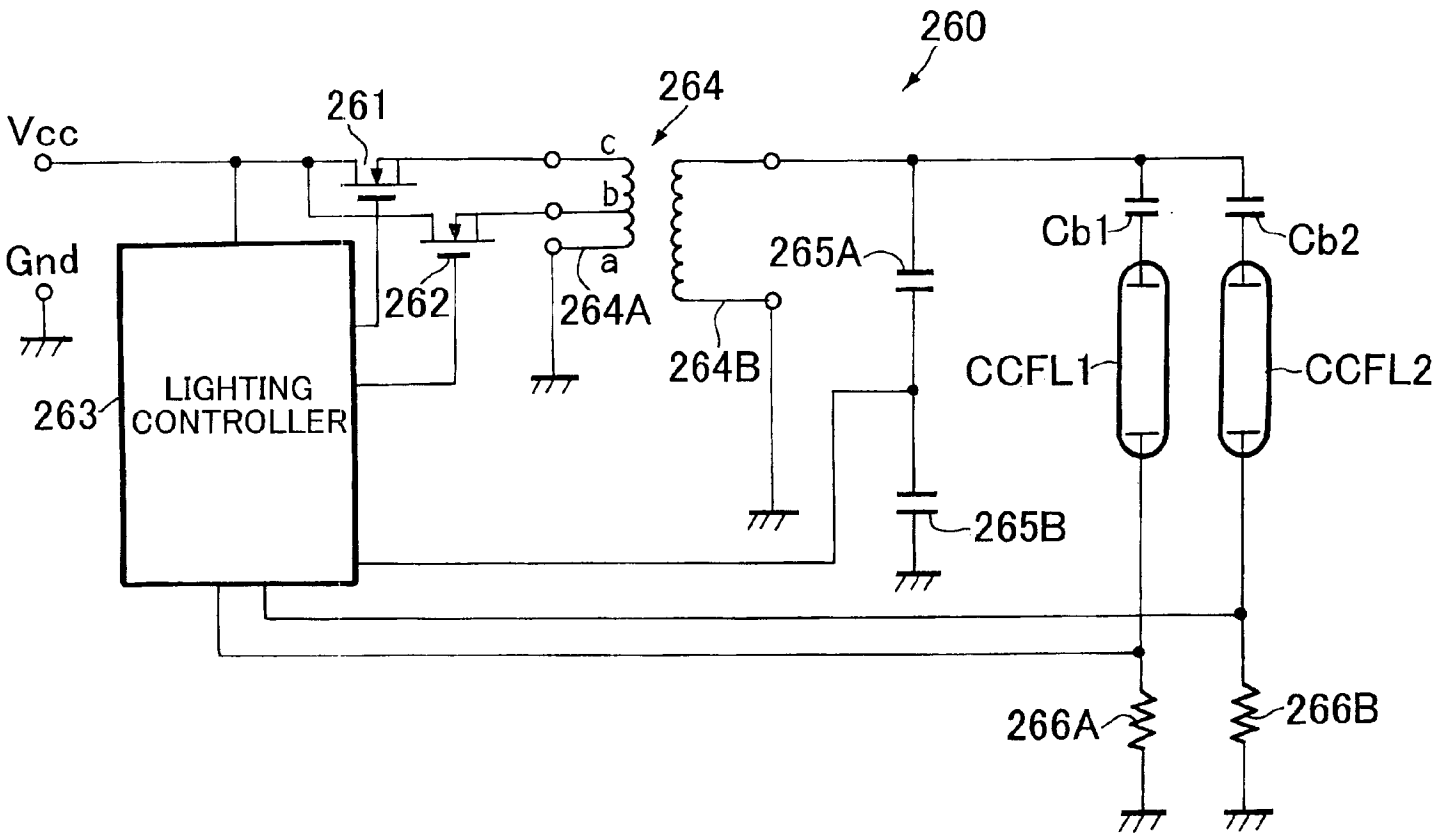
FIG. 9 is a circuit diagram showing a modified mode of the discharge lamp driving circuit of FIG. 3.

FIGS. 8 and 9 show modified modes of the discharge lamp driving circuit of FIG. 3. In FIG. 8, members corresponding to those of FIG. 3 are referred to with numerals adding 100 to those of FIG. 3. In FIG. 9, members corresponding to those of FIG. 3 are referred to with numerals adding 200 to those of FIG. 3. These members will not be explained in detail.

The discharge lamp driving circuit shown in FIG. 8 differs from that of FIG. 3 in that the third-stage switching section of its full-bridge circuit 160 comprises a single FET 162C, and that its starter primary coil 164D and normal lighting primary coil 164C are formed independently from each other. Namely, in the discharge lamp driving circuit shown in FIG. 8, the switching for initially lighting the discharge lamps is effected by the ON/OFF operation of the FET 162C in the third-stage switching section alone.

Therefore, as compared with the discharge lamp driving circuit shown in FIG. 3, the one shown in FIG. 8 is simpler in the circuit configuration and switching control, and can cut down the manufacturing cost since the number of FETs is reduced by 1.

The discharge lamp driving circuit shown in FIG. 9 uses two FETs 261, 262 instead of the full-bridge circuit, so as to regulate the input voltage to its primary coil 264A. Namely, switching the FET 262 energizes the starter primary winding (a–b), whereas switching the FET 261 provided with the power line ($V_{cc}$) energizes the normal lighting primary winding (a–c).

Therefore, as compared with the discharge lamp driving circuit shown in FIG. 3, the one shown in FIG. 9 is much simpler in the circuit configuration and switching control, and can cut down the manufacturing cost greatly since the number of FETs is much smaller.

Figure 10:
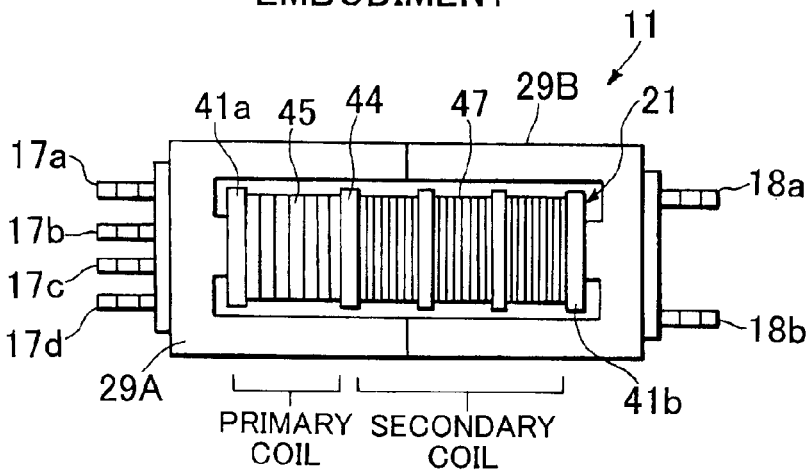
FIG. 10 is a schematic plan view showing a modified mode of the high-voltage transformer shown in FIG. 1.

FIG. 10 shows a modified mode of the high-voltage transformer shown in FIG. 1. The high-voltage transformer shown in FIG. 10 is one in which a pair of so-called E-shaped magnetic cores 29A, 29B are opposed to each other, so as to form a core part. Also, its secondary coil 47 is provided with insulating brims at predetermined intervals in order to secure a favorable state of insulation.

Without being restricted to the above-mentioned embodiments, the high-voltage transformer and discharge lamp driving apparatus of the present invention are applicable to various types of transformers such as those disclosed in Japanese Unexamined Patent Publication No. 2002-299134 and Japanese Patent Application No. 2002-334131 (including both single and double transformer types in which a wound primary coil is positioned at the outer periphery of a wound secondary coil), for example, as a matter of course.

Though the above-mentioned embodiments show examples in which two CCFLs are lit by a single transformer, three or more CCFLs may be lit by a single transformer as well.

The high-voltage transformer of the present invention is applicable to not only inverter transformers, but also various kinds of transformers.

Though the magnetic core is preferably formed from ferrite as mentioned above, materials such as permalloy, Sendust, and carbonyl iron, for example, may also be used. A dust core compression-molded from fine powders of these materials can be used as well.

As explained in the foregoing, while a high voltage is generated from the secondary coil at the time when discharge lamps start lighting, the high-voltage transformer of the present invention switches the voltage-applying primary winding from the starter winding to the normal lighting winding at the time of normal lighting after the discharge lamps start lighting, so as to lower the secondary voltage to a level necessary and sufficient for the discharge lamps to keep lighting. This can prevent the secondary coil of the high-voltage transformer from continuously outputting the high voltage for initially lighting the discharge lamps.

Though the secondary voltage is divisionally applied between both ends of each ballast capacitor by a predetermined ratio, the voltage between both electrodes of each discharge lamp at the time when the discharge lamp starts lighting and that at the time when the discharge lamp normally lights can be secured, whereby operations for initially lighting the discharge lamps and normally lighting the discharge lamps can be carried out favorably.

What is claimed is:

1. A high-voltage transformer for lighting a plurality of discharge lamps, said high-voltage transformer comprising a primary coil for inputting an AC voltage and a secondary coil for outputting a predetermined AC voltage higher than said AC voltage inputted, wherein said primary coil comprises a starter primary winding for initially lighting said discharge lamps, and a normal lighting primary winding for normally lighting said discharge lamps, and wherein said starter primary winding has a smaller number of turns than that of said normal lighting primary winding.

2. A high-voltage transformer according to claim 1, wherein said starter primary winding is comprised by a part of said normal lighting primary winding by providing a tap in said normal lighting primary winding.

3. A high-voltage transformer according to claim 1, wherein said starter primary winding is provided independently from said normal lighting primary winding so as to have a diameter smaller than that of said normal lighting primary winding.

4. A high-voltage transformer according to claim 1, wherein said high-voltage transformer is an inverter transformer.

5. A high-voltage transformer according to claim 1, wherein said discharge lamps are cold cathode fluorescent lamps.

6. A discharge lamp driving apparatus comprising the high-voltage transformer according to claim 1, said apparatus further comprising:

first switching means for controlling an energizing state of said starter primary winding; and second switching means for controlling an energizing state of said normal lighting primary winding.

7. A discharge lamp driving apparatus according to claim 6, wherein a switching frequency for driving said first switching means and a switching frequency for driving said second switching means are switchable therebetween.

8. A discharge lamp driving apparatus according to claim 6, wherein said first and second switching means form a full-bridge circuit.

9. A discharge lamp driving apparatus according to claim 6, wherein said first and second switching means are partly used in common.

10. A discharge lamp driving apparatus according to claim 6, wherein said first switching means energizes said starter primary winding for a predetermined time, and then said second switching means energizes said normal lighting primary winding.

* * * * *